United States Patent [19]

Torelli et al.

[11] 4,116,163

[45] Sep. 26, 1978

[54] APPARATUS TO COAT A FLOWING MASS OF PARTICULATE MATERIAL

[75] Inventors: Aldo Torelli, Oberwil; Erwin Prinz, Adliswil, both of Switzerland

[73] Assignee: Peter Fahrni, Kilchberg, Switzerland

[21] Appl. No.: 853,590

[22] Filed: Nov. 21, 1977

[30] Foreign Application Priority Data

Nov. 26, 1976 [CH] Switzerland ..... 14905/76

[51] Int. Cl.[2] ..... B05B 17/00

[52] U.S. Cl. ..... 118/303; 427/214; 427/240

[58] Field of Search ..... 118/303, 24, 25, 52; 427/212, 214–222, 3, 6, 240, 241; 239/223, 224

[56] References Cited

U.S. PATENT DOCUMENTS

| | | | |
|---|---|---|---|
| 1,120,730 | 12/1914 | Marx | 427/212 X |
| 1,869,235 | 7/1932 | Bartling | 427/215 |
| 2,097,914 | 11/1937 | Cooper et al. | 118/303 |
| 3,009,825 | 11/1961 | O'Brien | 427/218 |
| 3,198,655 | 8/1965 | Gisiger | 427/212 |
| 3,213,867 | 10/1965 | McIntyre | 118/303 X |
| 3,969,546 | 7/1976 | Saeman | 427/215 X |

FOREIGN PATENT DOCUMENTS

| | | | |
|---|---|---|---|
| 1,577,656 | 6/1969 | France | 118/303 |
| 301,116 | 12/1969 | U.S.S.R. | 118/303 |

*Primary Examiner*—Morris Kaplan
*Attorney, Agent, or Firm*—Anthony J. Casella

[57] ABSTRACT

In the manufacture of chip board panels, the chip parts are sprayed with a bonding agent, and in the subject process, a curtain of chip particles of rotational symmetry relative to a vertical axis is first coated with the sprayable binder, after which the particles fall onto a generally horizontal rotating plate, whereby the particles are deflected and slung outwardly where the particles are again exposed to the effect of the spray jet. Thereafter, the particles are deflected downward for further treatment or collected and removed. The apparatus includes a circular particle delivery part for the formation of the rotationally symmetrical curtain, a spray device arranged within the curtain and concentric to it, and a rotating plate supported concentrically to the axis of the curtain particles and spaced away from the feed point of the particles. The assembly is disposed within an outer housing whereby after the particles are deflected and slung outwardly, and again passed through the spray jet, the particles are then deflected downwardly for further treatment or collection.

10 Claims, 4 Drawing Figures

APPARATUS TO COAT A FLOWING MASS OF PARTICULATE MATERIAL

The present invention relates to means to effect a multi-step process for applying a sprayable agent onto a material consisting of loose granulate, scale, chip, or fiber parts by spraying a spray agent against the inside of a curtain formed of particles which are falling freely or with additional acceleration, the curtain having rotational symmetry with respect to a vertical axis.

By the expression "spray agent" there is to be understood in the present case any liquid, viscous agent or product or substance present in the form of small droplets or as emulsion, powder or the like which can be sprayed or atomized. The production of the spray jet can be effected in known manner by atomizing the spray agent, by a centrifugal action, by means of electrostatic fields, etc. Depending on the nature of the spray agent, the size of the plant and other requirements, one can use several individual nozzles or a circular nozzle. In particular, in the prior art methods, it is known to arrange a downward directed nozzle in the central region of the curtain of particles, which nozzle produces a jet of spray agent whose shape corresponds geometrically to the shape of a hollow cone. Of course, the jet can also widen in cross section as it moves away from the nozzle. Finally, it should be pointed out that the curtain of particles need not absolutely have the geometrical shape of a hollow cylinder; it could, in principle, also have a generally conical shape. The downward-falling or accelerated particles which form the curtain of particles can, during their passage over the path on which they participate in the formation of the curtain of particles, also carry out a movement of rotation around the longitudinal axis of the curtain of particles, in addition to the falling movement.

A multi-step process within the meaning of the definition given above has been customary, for instance, for many years in the manufacture of chipboards. In this process a curtain of particles of rotational symmetry is first of all produced by means of rotating blades, the particles of wood fiber thereby being imparted an additional acceleration which is formed of a tangential component and a vertical component. As a result, the curtain of particles is torn apart so that a better distribution of the sprayed binder can be obtained.

However, it has been found that even such a known method is still defective and does not assure a sufficiently uniform distribution of the binder over the surface of the chips. For this reason the curtain of particles after it has fallen through the spray zone is conducted into a mixer which has mixing arms rotating therein.

This second method step, to be sure, improves the distribution of the binder but, on the other hand, unfortunately has various defects which it was not possible up to the present time to eliminate. In particular, such a mixer, due to its size, is very expensive and bulky. Furthermore, the energy required for the mixing process, i.e. the turning over of the particles, is considerable. The relatively large extent of dirtying of the agitator arms and machine walls is also disadvantageous. In addition to this, the flow of the chips through the mixer does not take place uniformly. The chips which are moved about are subject to statistical laws and frequently remain in the mixer only for a very short time while in other cases they remain therein for an unnecessarily long time. Finally, the chips are frequently comminuted in such after-mixers as a result of the mechanical stresses particularly when there are concerned flat chips such as, for instance, are frequently used for the formation of outer layers.

The problem which forms the basis of the invention lies in particular in the development of means in which the above mentioned drawbacks are not present. In accordance with the invention, the method is to be carried out for this purpose in such a manner that the particles which form the curtain after they have passed through the region lying in the direct range of spray of the spray jet are so deflected and flung away from the axis of the curtain of particles in the form of an annular fan that during this slinging motion they are subjected to the action of the part of the spray jet which passes through the curtain of particles, whereupon they are deflected downward and further treated or collected and removed.

The invention also has as its object an apparatus for the carrying out of this method. In known manner, this apparatus has a circular particle delivery station for the formation of a curtain of downward moving particles which is of rotational symmetry with respect to a vertical axis, a spray device arranged within said curtain and concentrically to it in order to produce a spray jet which is directed against the inside of the curtain of particles, and furthermore a machine housing.

In contradistinction to the known devices of this type, the device in accordance with the invention is provided with a rotating plate which is supported concentrically to the axis of the curtain of particles and spaced from the particle feed station and is coupled with drive means, and particle deflection means arranged outside the periphery of the rotating plate. Furthermore, the spray device should be of such a nature and the position, speed of rotation and shape of the rotating table so selected that for a given particle material the part of the spray jet which passes through the vertical curtain of particles impinges on the particles which are thrown in fan form off from the rotating plate.

The use of a rotating plate for the deflecting of the particles and the slinging off of them results in a particularly simple method and an uncomplicated machine which is compact and cheap to manufacture. The drive of the rotating plate requires very little power, for instance 2 to 3 hp, instead of about 40 hp for a comparable mixer with rotating mixing arms. A self cleaning effect of the machine has also been noted as a result of the outward travel of the chips in a thin layer on the rotating plate. The apparatus has in particular also fundamental effects with respect to the quality of the sizing of the chips. In fact, despite the extremely modest expense, the distribution of the binder over the chip surfaces is made so uniform that further measures are in principle superfluous. The uniform distribution is due, not least of all, to the substantially constant time of stay of the chips within the machine. The flow of the chips is continuous. The undesired comminuting effect which favors the formation of dust is practically eliminated since the chips are subjected to only very little mechanical stress upon passing through the different stages.

It has now been found that particularly good results are obtained when using a rotating table whose active surface rises slightly from the inside towards the outside. The layer of chips which is formed on the surface of the plate and travels towards the outside as a result of the centrifugal force thereby has a particularly favorable angle with respect to the part of the jet of spray agent which passes through the curtain of particles. Furthermore, the friction between the chips and the surface of the plate is thereby increased. This if favorable if a particularly high self-cleaning effect is desired. Finally, due to the use of a rotating plate which moves the chips or other particles outwards, a sorting effect which would impair the uniformity of the gluing is avoided. In other words, therefore, chips of given sizes are not preferred during the gluing. This is equivalent, in result, to a more economical use of the expensive binders.

The apparatus will be described by way of example below with reference to the drawings. There is concerned here the application of a coating of a thermosetting binder to wood chips, wood shavings, or the like such as are used to a large extent for compression to form particle boards with the use of heating presses.

Figure 1:
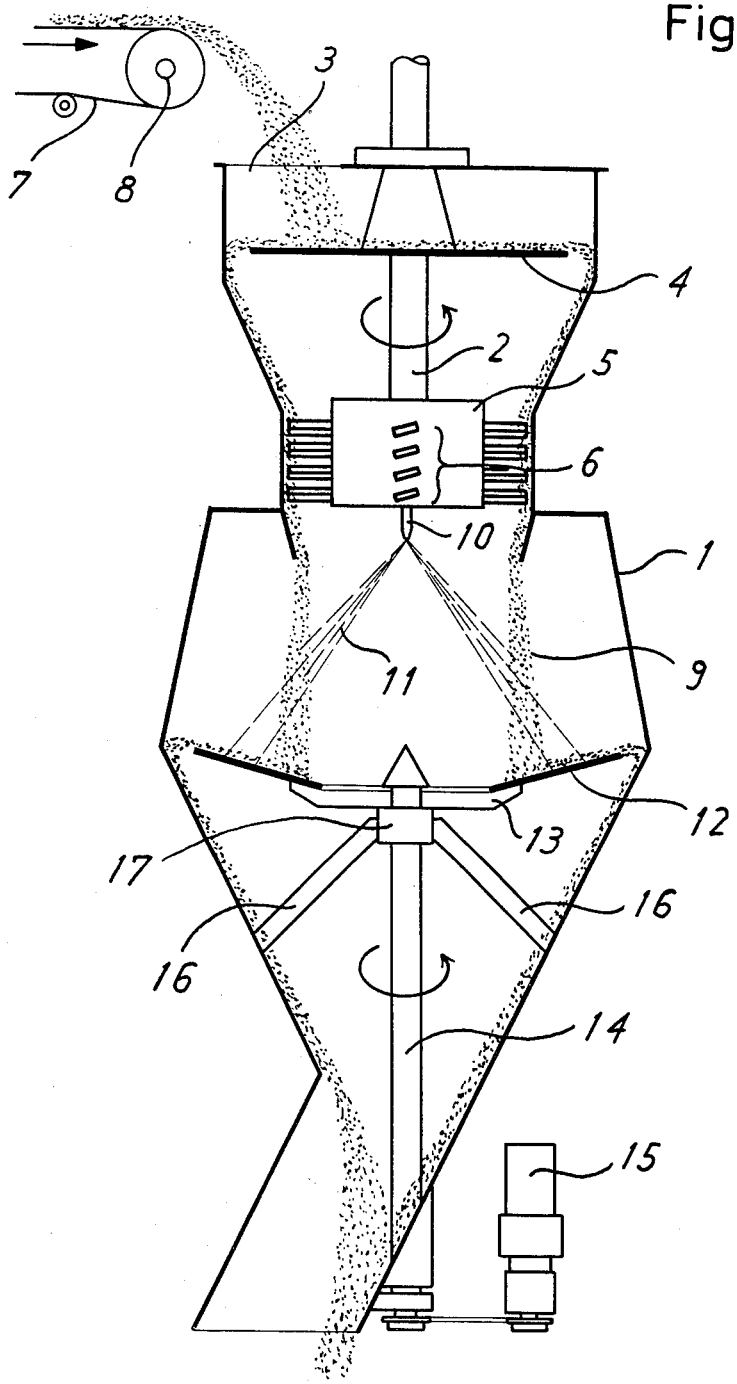
FIG. 1 is a longitudinal section through a two-step chip gluing machine having a rotating plate.

In the case of the embodiment shown in FIG. 1, a machine housing 1 is provided which has a vertically arranged rotary drive shaft 2 supported in its upper part. This shaft 2 which is driven in a manner not shown in detail is provided, in the vicinity of an upper opening 3 in the machine housing, with a flat rotating plate 4 onto which particles of wood which are to be glued for the production of particle boards are strewn by means of a conveyor belt 7 which is reversed in direction at 8. The distributing plate 4 throws the particles against the inner wall of the housing along which they trickle downward. At the lower end of the drive shaft 2 which is supported concentrically to the housing 1 there is seated a rotor 5 which is provided with several sets of slightly oblique blades. The purpose of the blades 6 is to impart additional acceleration to the freely downward falling particles of wood so that a relatively strongly expanded hollow-cylindrical curtain 9 of particles is formed at the particle delivery point formed by said rotor 5 and the part of the machine housing which surrounds said rotor at a distance from it. The shaft 2 is hollow and there extends through it along its length a binder feed line the lower end of which discharges into a nozzle 10. The nozzle jet 11 has the geometrical shape of a hollow cone; in the example shown it consists of a sprayable thermosetting binder. It is to be distributed as uniformly as possible over the surface of the chips. Chip gluing machines of the type just described are in themselves known but they have the disadvantage that the uniformity of the gluing is not yet assured. Therefore, as already indicated, recourse has already been had to multi-step processes and an actual mixing and revolving stage is provided behind the spray step shown.

The invention proceeds along entirely new paths and proposes bringing the particles, after passage through the spray jet zone, again into the region of said jet insofar as it is still present after passage through the curtain of particles. For this reason the apparatus shown is provided with a rotating plate 12, the upward directed surfaces of which, as can be noted from the sectional view, extend upward in the direction of the machine housing at an acute angle to the horizontal. The rotating plate 12 is fastened by means of struts 13 to a shaft 14 which is placed in rotation by a motor 15. Supports 16, serving as holders for a bearing 17, serve to provide the required stability for the vertical shaft 14. The machine housing 1 is narrowed in funnel shape at its lower part.

The rotating plate 12 has a relatively small speed of rotation of, for instance, 60 rpm. With a rotating plate having an outside diameter of, for instance, 1.5 m, this speed is sufficient to impart the particles sufficient centrifugal acceleration. The speed of rotation of the rotating plate 12 is dependent not least of all on the nature of the particles, the viscosity of the binder, the nature of the surface of the rotating plate, and other factors.

The outwardly centrifuged particles strike against the inner wall of the machine housing which is opposite the inner side of the periphery of the rotating plate, are deflected there and trickle thereupon down along the conical wall towards the outlet from the housing. The particles which fall onto the inner part of the plate carry out a spiral movement on the plate as a result of the rotary movement of the latter and the centrifugal force produced thereby. This movement takes place, to a certain extent, also during the downward trickling in the machine housing. After the gluing process described, the particles are collected and removed by a conveyor means, not shown. However, it is also conceivable to provide one or more treatment stages of any type behind the two gluing stages.

Figure 2:
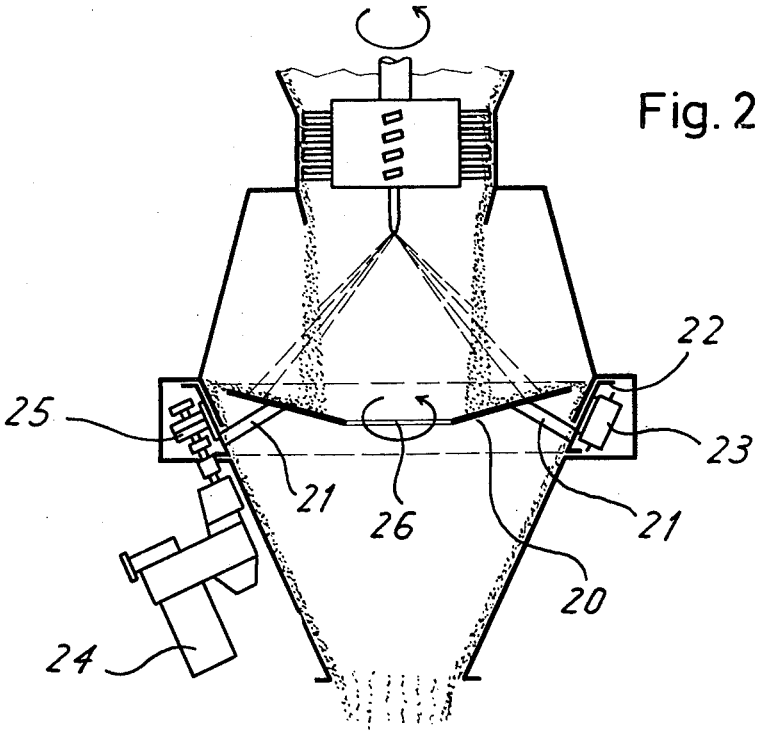
FIG. 2 is a partial sectional view of another embodiment of the machine.

In the second embodiment, shown in FIG. 2, a rotating plate 20 is also provided. However, it is not held on a shaft which is supported concentrically to the housing. Rather, the plate 20 rests by means of struts or profiled bars 21 on a rotatably supported ring 22 which is accessible from the outside of the machine housing and extends over the periphery of said housing, the ring resting on a plurality of rollers 23 which are distributed around the periphery. On the right-hand side of FIG. 2 it can be seen that the shaft which holds the roller 23 is inclined corresponding to the inclination of the outer surface of the ring. On the left-hand side a drive motor 24 has been diagrammatically indicated. This motor places the ring 22 in rotation via a friction roller which acts on the outer surface of the ring. Instead of a friction wheel, a gear which cooperates with the toothing of the ring, a chain, a rope or the like could also be used.

FIG. 2 also shows that the inner wall of the machine housing extends over a part of the inner surface of the ring. This prevents disturbance with the free flow of chips. Finally, it can be seen that the rotating plate 20 is provided with an opening 26 in its central part.

Figure 3:
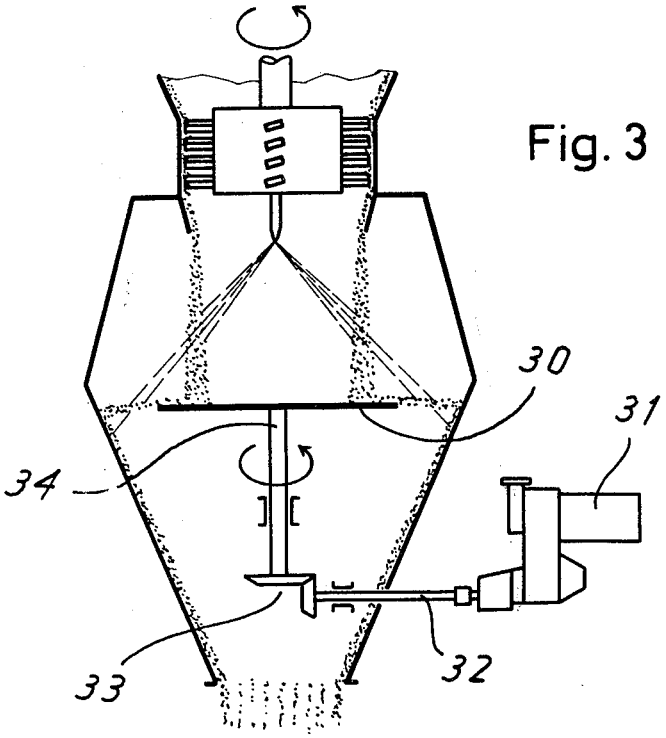
FIG. 3 is a partial sectional view of a third embodiment of the gluing machine.

The third embodiment, shown in FIG. 3, has a smaller flat rotating plate 30 whose peripheral diameter is relatively small, so that the particles, after leaving the plate, move over a relatively long path before they strike against the inner wall of the housing. This development makes it possible to utilize the remainder of the circular spray jet of binder which may pass through said horizontal layer of particles. The gluing process is in this case thus even a three-stage process. This is particularly economical and contributes to keeping the parts of the machine clean. Of course, the speed of rotation of the plate 30, the width of the slot between the periphery of the plate and the inside of the machine housing, the nozzle pressure, etc. must be so adapted to each other that the spray mist which passes through the vertical curtain of particles and the substantially horizontal layer of particles produced by the centrifugal action actually strikes against the particles which are trickling downward along the inner wall of the housing.

The rotating movement of the plate 30 is produced by a motor 31 and transmitted by a shaft 32, a bevel-gear transmission 33 and a vertical shaft 34 to said plate.

Figure 4:
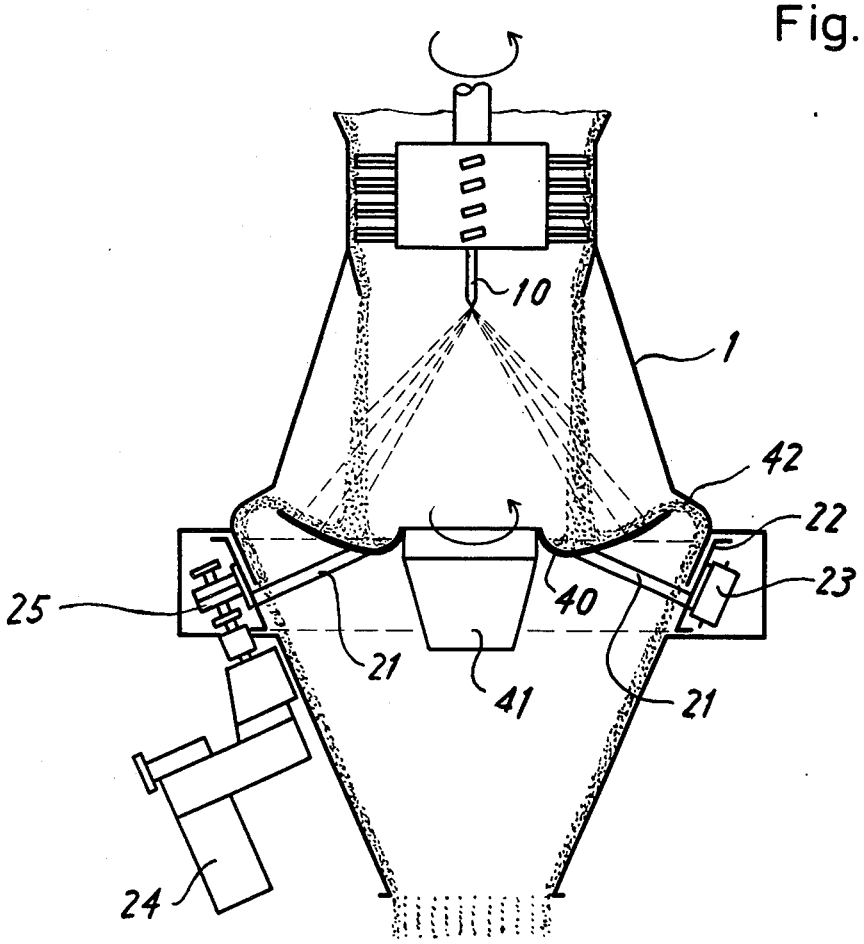
FIG. 4 is a partial sectional view of a fourth embodiment of the gluing machine.

The embodiment shown in FIG. 4 has in a certain respect a somewhat different manner of action since in this case the rotating plate is of a specially designed shape which counteracts too strong a thinning of the radially travelling layer of particles formed by centrifugal action on the surface of the rotating plate and thus prevents a dirtying of the surface of the rotating plate covered by the particles to an even greater extent than the conical rotating plate shown in FIG. 1 and 2. The rotating plate 40 is for this purpose arched in such a manner that its active surface has a generally concave shape. The radius of curvature becomes greater upon an increase in the distance from the surface of the rotating plate. The rotating plate, in other words, has such a course in cross section that with increasing distance from the axis of rotation the tangent to the curve forms a larger angle with a horizontal. In the ideal case, the course of the curve in radial direction is so selected that with due consideration of the speed of rotation of the plate 40 and of the specific friction conditions the difference between the force driving the particles along the surface of the plate towards the periphery of the plate and the frictional force acting radially on the particles is constant over the entire region passed over by the particles. Of course, this condition cannot always be precisely satisfied. In general, an approximation to the optimal conditions is satisfactory, for instance by providing a plurality of sections of different inclination which are linear as viewed in the radial cross section of the rotating plate, so that a substantially concave plate shape is also formed.

From the sectional showing given in FIG. 4, the shape of the rotating plate 40 in the annular impingement region of the curtain of particles can also be noted. Within this inner region the shape of the plate is arched upwards with a small radius of curvature so that a particle-deflecting trough is formed in which neither particles nor residues or binder can deposit. Both this impingement region and the actual slinging surface of the rotating plate are concave and pass into one another without transition.

The rotating plate 40 which is in principle annular, bears in its central region a substantially conical hollow body 41. The latter has the shape of rotational symmetry and is coaxial to the rotating plate 40 and to the geometric axis of rotation of the plate 40. The shaft-like hollow body 41 prevents an undesired splattering of large drops of glue against the chips which move downward within the machine housing upon the turning on and off of the feed of glue to the nozzle 10. Finally, FIG. 4 also shows that the machine housing is so developed in the region in which the chips thrown away from the rotating plate impinge that the chips rebound slightly and are deflected downward. In this particle impingement and deflection region which is designated 42 the housing has a conical downwardly widening shape. The generatrices of this region form downwardly open acute angles with the geometrical axis of rotation of the plate 40. The shape of the housing which has just been described improves the self-cleaning effect and accordingly facilitates the maintenance of the machine.

Otherwise, the device shown in FIG. 4 is of the same development as the device of FIG. 2. In particular, in the embodiment last discussed the rotating plate is also fastened by means of braces 21 to a rotatably supported ring 22 which is driven by means of an electric motor 24 via a friction wheel 25. The ring 22 lies on a plurality of rollers 23 distributed on the periphery.

It is self-evident that depending on the nature of the material and the other parameters the speed of rotation of the centrifugal plate and the shape thereof are adapted to each other. The optimal conditions can be determined by calculation or empirically.

What is claimed is:

1. Apparatus for coating particulate material comprising:

a housing having means therein to establish a freely falling annular curtain of said particulate material;

a spray device disposed within said curtain and concentric thereto and effecting at least one jet of coating material directed against the inner side of the curtain whereby a first coating is applied to the particulate material and a remainder portion of the spray passes through the curtain;

a rotatable plate member supported concentrically to the axis of said curtain and disposed so as to intercept said annular curtain after the impringment thereon of said directed spray;

drive means rotating said plate so as to subject the intercepted particulate material to centrifugal forces whereby the intercepted particulate travels radially across the plate and is flung outwardly therefrom;

said housing being configured so as to deflect the outwardly flung particulate material and to guide the deflected material to discharge from said apparatus; and the directed spray portion passing through the curtain impinges on a portion of said plate lying outside of the curtain path whereby the intercepted particulate material moving radially across the plate due to said centrifugal forces is subjected to an additional coating operation.

2. Apparatus according to claim 1 wherein said drive means comprises a driven annular member which is connected to said plate to effect said support and which is disposed in an outer peripheral portion of said housing, and said housing being further configured so as to shield said driven member.

3. Apparatus according to claim 1, wherein said plates is at least in part developed as a conical surface which rises slightly from the inside towards the outside.

4. Apparatus according to claim 3, wherein the plate annulus is generated by a cross-section that has a generally concave shape.

5. Apparatus according to claim 4, characterized by the fact that the radius of curvature of the active surface of the rotating plate becomes greater with increasing distance from the axis of the rotating plate.

6. Apparatus according to claim 5, characterized by the fact that the surface of the rotating plate has an upwardly extending conically arched section in the annular impingement region of the curtain of particles, which section passes continuously into the actual slinging surface of the rotating plate (40) which extends in the direction of the periphery of the rotating plate.

7. Apparatus according to claim 2, characterized by the fact that the rotating plate (12) has an opening (26)

in its central region which is not covered by the downward falling particles.

8. Apparatus according to claim 1, characterized by the fact that between the periphery of the rotating plate and the region of the inner side of the housing (1) lying opposite to same there is a circular slot and that the machine housing narrows downward in funnel shape from said region which acts as means to effect said deflection and guidance of the deflected particulate to discharge.

9. Apparatus according to claim 8, characterized by the fact that the generatrices of the region of the housing which act as said deflection and guidance means form downwardly open acute angles with the axis of rotation of the rotating plate.

10. Apparatus according to claim 1, characterized by the fact that the surface of the rotating plate (30) is at least approximately flat.

* * * * *